US005538318A

United States Patent [19]

MacLean

[11] Patent Number: 5,538,318

[45] Date of Patent: Jul. 23, 1996

[54] COMBINATION BACKPACK AND CHAIR

[76] Inventor: Shian MacLean, 7027 Dublin Blvd., Dublin, Calif. 94568

[21] Appl. No.: 423,779

[22] Filed: Apr. 18, 1995

Related U.S. Application Data

[63] Continuation-in-part of Ser. No. 392,148, Feb. 22, 1995.

[51] Int. Cl.[6] ..... A47C 13/00

[52] U.S. Cl. ..... 297/129; 224/155; 297/183.5

[58] Field of Search ..... 297/39, 40, 129, 297/183.5; 224/155

[56] References Cited

U.S. PATENT DOCUMENTS

| | | | |
|---|---|---|---|
| 3,250,449 | 5/1966 | Woodman | 224/9 |
| 4,487,345 | 12/1984 | Pierce et al. | 224/155 |
| 4,582,165 | 4/1986 | Latini | 224/155 |
| 4,676,548 | 6/1987 | Bradbury | 297/129 |
| 4,720,029 | 1/1988 | Varanakis | 224/155 |
| 4,747,526 | 5/1988 | Launes | 224/155 |
| 4,762,256 | 8/1988 | Whitaker | 224/155 X |
| 5,297,708 | 3/1994 | Carpenter | 224/155 |
| 5,318,342 | 6/1994 | Hale | 297/129 |
| 5,381,941 | 1/1995 | Brune | 224/155 |

FOREIGN PATENT DOCUMENTS

| | | | |
|---|---|---|---|
| 1469054 | 3/1977 | United Kingdom | 297/129 |

*Primary Examiner*—Peter R. Brown

[57] ABSTRACT

A pack frame that is convertible to a chair, having a generally rectangular shaped back section which has fittings that allow a back pack to be attached to it, and a generally rectangular shaped seat section pivotally connected to the back section. The seat section has a rigid frame at the sides and back but not at the front. The back and seat sections have fabric or plastic panels attached to each respectively that form the back and seat of the chair. A front leg section and a rear leg section are each pivotally connected to the seat section. Two adjustable shoulder straps are each attached at one end to a cross member connecting the left front leg and the right front leg at a point below the front of the chair seat and the shoulder straps are connected at the other end to the lower portion of the rear leg member of the chair. When the invention is folded into position for use as a pack frame, retaining clips hold the front and rear legs together. All horizontal cross members are shaped to curve away from the user's body, so they will not come in contact with the user's body when the invention is used as a pack frame, for the comfort of the user. The invention is designed to be used with a padded hip belt and ventilated back pad for the user's comfort.

5 Claims, 2 Drawing Sheets

COMBINATION BACKPACK AND CHAIR

This is a continuation-in-part of application Ser. No. 08/392,148, filed on Feb. 22, 1995.

BACKGROUND

1. Field of Invention

This invention relates to a combination backpack and chair.

2. Description of Prior Art

Backpacks are used to distribute the weight of a pack and its contents comfortably to the user's shoulders, back and hips. A pack frame distributes the weight and also allows ventilation between the pack and the user's back and shoulders, which contributes to the comfort of the user.

Backpacks and pack frames are designed to be lightweight and strong and to distribute the load comfortably by means of attached padded shoulder straps, padded hip belts, and metal frame members that are designed to curve around the user's neck, back and hips so that the metal pack frame members do not rub against the user's backbone, neck, hips or shoulders. Pack frames are fitted with ventilated mesh fabric pads that will come in contact with the user's back so that the user has ventilation between the pack frame and the user's back.

Folding chairs, usually made of aluminum tubing or other lightweight metal tubing, with fabric or vinyl seats and backs are also designed to be lightweight, strong and comfortable.

Devices of prior art consisting of back packs or back pack frames that convert to a folding chair have resulted in compromises that are either not comfortable or practical when used as a backpack or pack frame, or not comfortable or practical when used as a chair, or not comfortable or practical in either usage.

For example, U.S. Pat. No. 4,676,548 to Bradbury (1987) and U.S. Pat. No. 4,487,345 to Pierce and Merrill (1984) each present a combination folding chair and backpack which when folded into position to be used as a backpack, has tubular metal or wooden members, including the bottom of the chair legs and the front of the chair seat, that will rub uncomfortably against the user's backbone, neck and hips. The above mentioned prior art devices are not designed to include metal parts that curve around the user's back, neck and hips. They are also not designed to be used with padded hipbelts and ventilated back pads in order to make them comfortable to use as back packs.

Furthermore the above mentioned prior art devices have not solved the problem of constructing a combination pack frame and chair so that the cross pieces that connect the left and right sides of the chair will avoid rubbing the user's backbone, neck and hips when the device is in use as a pack frame, yet provide comfortable and practical support when in use as a chair.

The above mentioned prior art devices have not solved the problem of designing a device that will lock up into a rigid frame when it is to be used as a back pack frame and yet is easily unfolded into a chair. U.S. Pat. No. 4,676,548 to Bradbury (1987) describes a device that has to be fastened together with two separate pairs of straps that connect the tubular member forming the top of the chair back and the tubular member forming the front of the chair seat, and each pair of straps has to be fastened together by means of buckles.

The above mentioned prior art devices have the appearance of being uncomfortable and awkward to use as pack frames or back packs, and therefore do not have commercial appeal. The invention described in U.S. Pat. No. 4,676,548 to Bradbury (1987) has a number of disadvantages:

(a) The member that forms the bottom of the front legs will rub against the user's hips or backbone when used as a pack frame.

(b) The member that forms the front of the seat will rub against the backbone, neck or shoulders of the user when used as a pack frame.

(c) When folded up into a backpack the invention does not lock together easily into a rigid pack frame. The user would have to manually fasten two sets of straps together to hold the device in position as a backpack.

(d) The invention does not unfold into a full size chair that would be comfortable for the average adult, but instead has very short legs and is not high enough to be comfortable.

(e) It requires a low back so that when the device is folded into position as a chair, the top of the back and the front of the seat will be adjacent to each other so that they can be fastened together by means of straps.

(f) It has no padded hipbelts or ventilated backpad to provide comfortable support when used as a backpack.

OBJECTS AND ADVANTAGES

Accordingly, several objects and advantages of my invention are:

(a) to provide a combination backpack and chair that is comfortable for use as a backpack and also comfortable for use as a chair;

(b) to provide a combination backpack and chair that locks together easily into a rigid frame when folded up;

(c) to provide a combination backpack and chair that has all the comfortable features of a well-designed backpack or pack frame, including "anatomical" design with cross-pieces shaped to curve away from the user's back, shoulders and neck for comfort, and padded hip belt and shoulder straps and ventilated back pad;

(d) to provide a combination backpack and chair, which when used as a chair, is sturdy and comfortable and can be used on most types of terrain, including sand or soft ground;

(e) to provide a combination backpack and chair which when used as a chair will hold an attached pack in an upright position for convenient access to the pack;

(f) to provide a combination backpack and chair that can be manufactured easily and economically;

(g) to provide a packframe that will support a variety of types and sizes of backpacks and that can also be used to carry additional loads because of the design of the back section and the rear leg section;

(h) to provide a combination pack frame and chair which has the appearance of a pack frame when it is folded into position to be used as a pack frame, so that it will be obvious to a person looking at the invention that it will be comfortable in use as a pack frame, and thus will have commercial-appeal;

(i) to provide a chair that can be folded up and carried on a person's back, with no additional backpack being attached to it;

(j) to provide a combination backpack and chair that is greatly improved over any previously disclosed combination backpack and chair by combining all of the following elements for the comfort and convenience of the user: cross members of the seat section, leg sections and the back section that are designed to curve away from the user's back, shoulders and hips when the combination backpack and chair is carried as a backpack; a seat section with no front cross member; padded shoulder straps; a padded hipbelt to help support the weight of the backpack and its contents; a ventilated back pad; a combination backpack and chair designed to lock easily into a compact folded position so that it will not unfold while being used as a backpack; and a combination backpack and chair that will support a heavy pack upright for the convenience of the user when it is in the chair position;

(k) to provide a combination backpack and chair that can be easily manufactured from a standard aluminum-frame folding chair.

Other objects and advantages of the present invention will become apparent from a consideration of the drawings and ensuing description.

Reference Numbers in Drawings

4 back section

4*a* back top cross member

4*b* back panel

6 seat section

6*a* seat rear cross member

6*b* seat panel

8 U-shaped front leg member

8*a* front leg lower cross member

8*b* front leg upper cross member

10 U-shaped rear leg member

10*a* rear leg cross member

12 left armrest

14 right armrest

16 left shoulder strap

18 right shoulder strap

20*a* and 20*b* left leg retaining clips

20*c* and 20*d* right leg retaining clips

22 padded hip belt

24 ventilated back pad

26*a*, 26*b*, 26*c*, 26*d*, 26*e*, 26*f* backpack attachment fasteners

DESCRIPTION—FIGS. 1 AND 2

Figure 1:
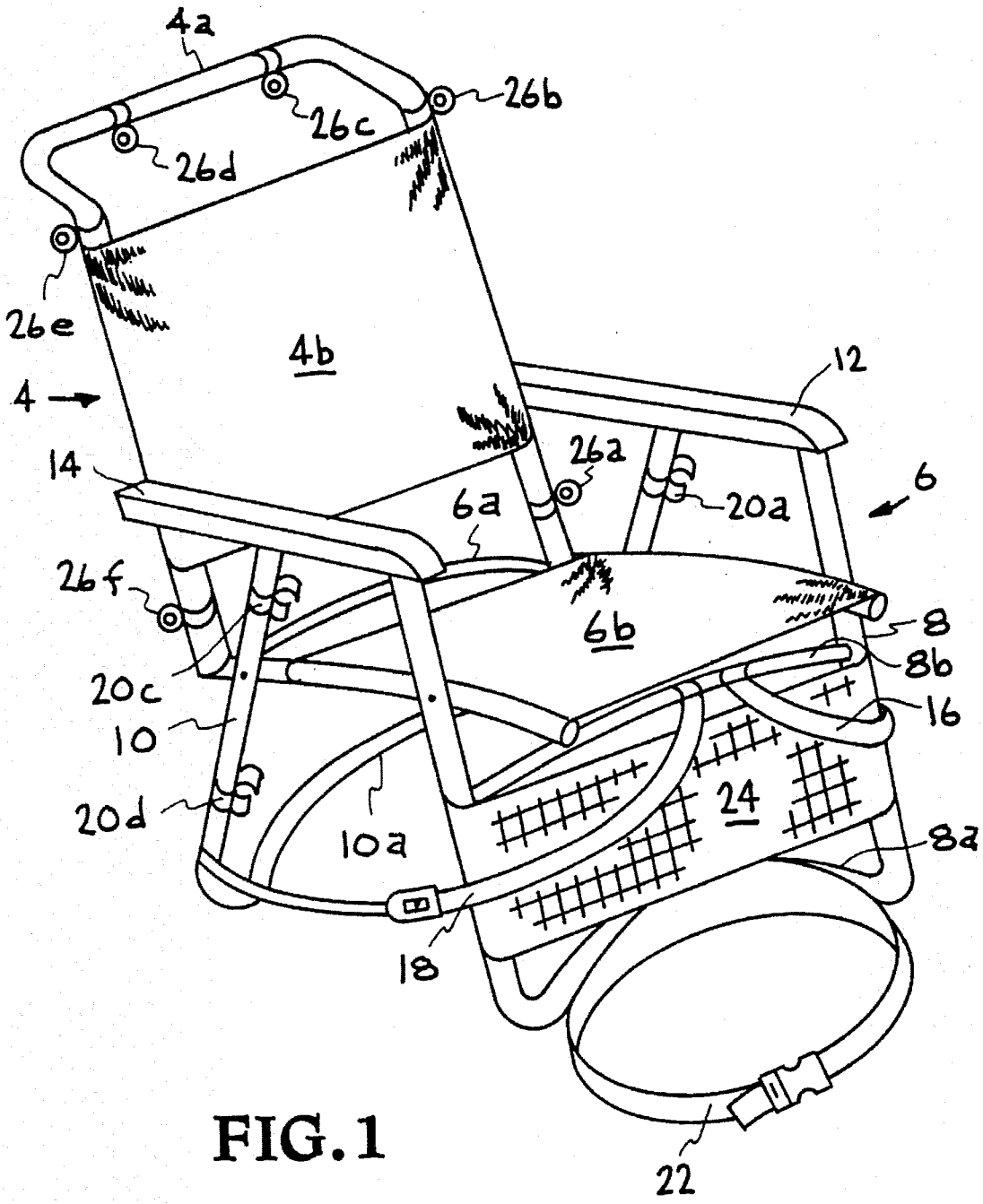
FIG. 1 is the combination pack frame and chair shown in the position as a chair.
Figure 2:
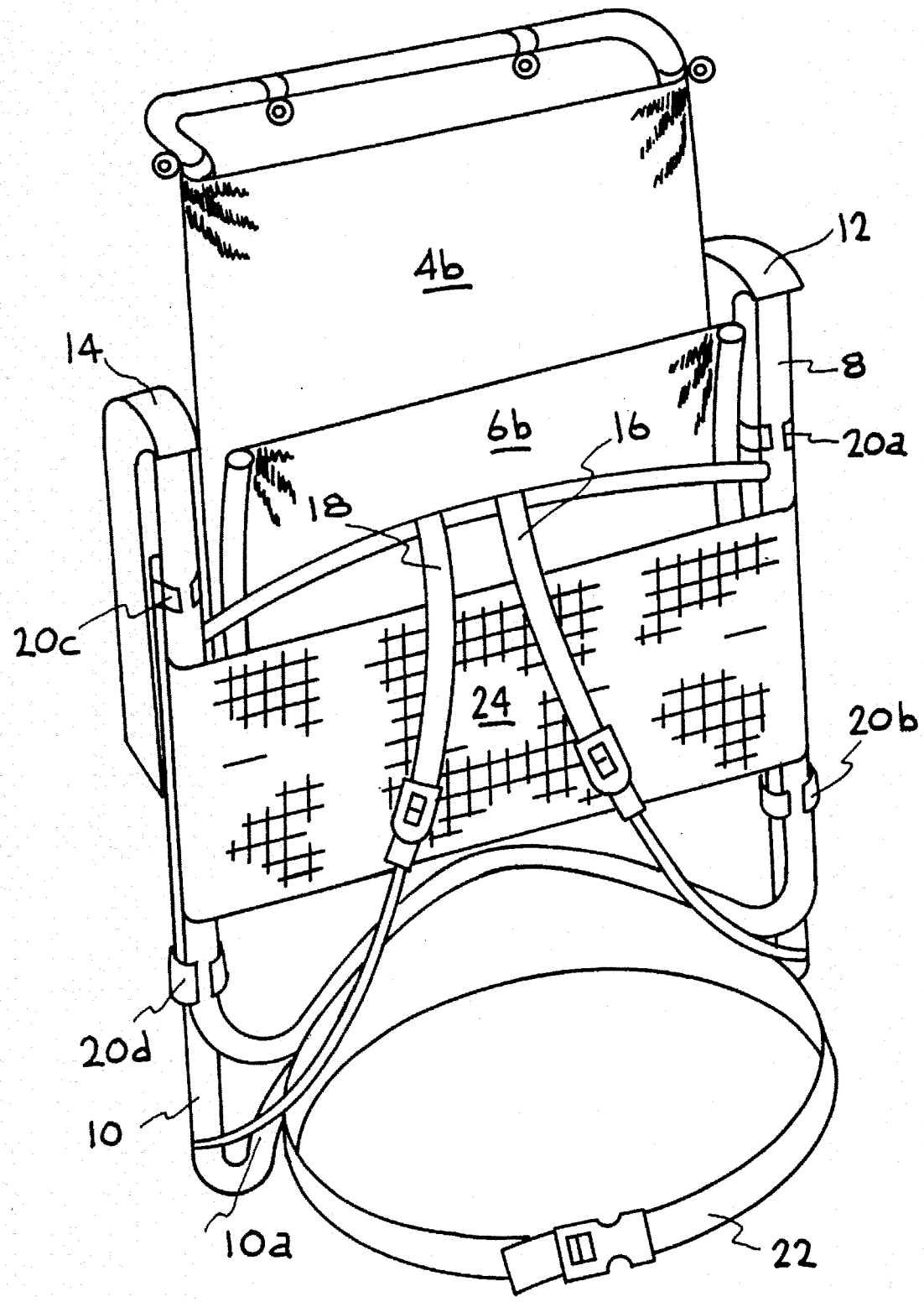
FIG. 2 is the combination pack frame and chair shown in the position to be used as a pack frame.

The preferred embodiment of the present invention is illustrated in FIGS. 1 and 2.

FIG. 1 shows the combination packframe and folding chair in the chair position. The combination pack frame and chair may be constructed with a light weight metal frame made from aluminum tubing or other metal or plastic that forms a generally rectangular shaped back section 4 and a generally rectangular seat section 6 that are pivotally connected to each other.

FIG. 1 shows back top cross member 4*a* formed so that it curves away from the front of the combination pack frame and chair, so that it has a concave or recessed surface on the side of back top cross member 4*a* that is closest to the back and shoulders of a person carrying the combination pack frame and chair when it is in the pack frame position. Back panel 4*b* may be constructed from fabric or plastic and is attached to the rectangular frame of back section 4.

Seat section 6 is formed of aluminum tubing shaped to form the sides and back of seat section 6 and covered with a fabric or plastic seat panel 6*b*. Seat rear cross member 6*a* is formed so that it curves upward, so that when the combination pack frame and chair is folded into the pack frame position, seat rear cross member 6*a* has a concave or recessed surface on the side closest to the back of a person carrying the combination pack frame and chair.

U-shaped front leg member 8 is pivotally attached to the left and right sides of seat section 6. Front leg member 8 has front leg upper cross member 8*b* attached to the left and right sides of front leg member 8 at positions below the points where seat section 6 is attached to front leg section 8, whereby the upper portion of front leg section 8 will be held rigidly apart and seat section 6 will support the weight of a person sitting in the chair. Front leg upper cross member 8*b* and front leg lower cross member 8*a* are curved so that both front leg upper cross member 8*b* and front leg lower cross member 8*a* each form a concave or recessed surface on the side closest to the back of a person carrying the combination pack frame and chair when it is in the pack frame position.

U-shaped rear leg member 10 is pivotally attached to the left and right sides of seat section 6 so that when the combination pack frame and chair is folded into the pack frame position, the left and right sides of front leg member 8 will lay flat against the left and right sides of rear leg member 10. Rear leg cross member 10*a* is curved so that it forms a concave or recessed surface on the side closest to the back of a person carrying the combination pack frame and chair when it is in the pack frame position.

Armrests 12 and 14 are pivotally connected to the ends of front leg member 8 and rear leg member 10 and to the left and right sides of back section 4.

All horizontal cross members of the invention, including back top cross member 4*a*, seat rear cross member 6*a*, front leg lower cross member 8*a*, front leg upper cross member 8*b*, and rear leg cross member 10*a*, are shaped so that they curve away from the user's neck, back, shoulders and hips when the combination packframe and chair is used as a pack frame. Rear leg cross member 10*a* is shaped so that it extends to the rear sufficiently so that when used as a chair the combination packframe and chair will support a pack and its contents attached to back section 4, without falling over. The extension of rear leg cross member 10*a* also allows the pack frame to support additional loads in addition to a pack, as the additional loads may be attached to rear leg cross member 10*a* when the invention is used as a pack frame.

Adjustable shoulder straps 16 and 18 are attached at one end to front leg upper cross member 8*b* and at the other end to the left and right sides of rear leg member 10.

Left leg retaining clips 20*a* and 20*b* and right leg retaining clips 20*c* and 20*d* are attached to the left and right sides of rear leg member 10 and clamp around the left and right sides of front leg member 8 when the invention is folded into the pack frame position, in order to hold the invention in a rigid, locked position for use as a packframe. The retaining clips may be made of any material such as plastic or metal that allows them to engage and disengage easily, to help hold the rear leg member 10 and the front leg member 8 together when the invention is in the packframe position.

As shown in FIG. 1 and FIG. 2, padded hip belt 22 is attached to front leg lower cross member 8*a* and may be fastened around the user's waist to help support the weight of the present invention when used as a pack frame. A ventilated back pad 24 is attached to front leg member 8 and is designed to rest against the user's back when the invention is used as a packframe.

Any conventional pack with plurality of compartments may be attached to the back section 4, and backpack attachment fasteners 26*a*, 26*b*, 26*c*, 26*d*, 26*e* and 26*f* are attached to or built into back section 4. These attachment fasteners may be any metal or plastic fittings such as are commonly used on backpack frames to attach a backpack.

In an alternate embodiment, the combination packframe and chair may be constructed with no attached fasteners for the attachment of a backpack, and may be used as a chair which can be carried as a backpack but without any additional pack attached.

As shown in FIG. 2, when the combination pack frame and chair is folded into the pack frame position, it is designed to be carried on a person's back so that only the shoulder straps, padded hip belt and ventilated back pad will come into contact with the person's body.

While the invention will be described in connection with a certain preferred embodiment it is to be understood that it is not intended to limit the invention to that particular embodiment. Rather, it is intended to cover all alternatives, modifications and equivalents as may be included within the spirit and scope of the invention as defined by the appended claims.

OPERATION—FIGS. 1 AND 2

The manner of changing the combination pack frame and folding chair, in its preferred embodiment, from one position to the other is as follows, starting with the invention in the pack frame position: Standing next to the pack frame the user holds the center of back top cross member 4*a* with one hand, and the center of front leg upper cross member 8*b* with the other hand. The user then unfolds the invention into the chair position. The leg retaining clips 20*a*, 20*b*, 20*c* and 20*d* are designed to release when the invention is unfolded from the packframe position, and to clamp the front and rear leg sections together when the invention is folded into the packframe position. In other embodiments, any other quick release latching devices may be used for the purpose of holding the combination pack and folding chair in the pack position.

SUMMARY, RAMIFICATIONS AND SCOPE

The reader will see that the present invention can be conveniently used as a backpack or backpack frame and chair. It has the following additional advantages:

- it is comfortable for use both as a backpack or pack frame and as a chair;
- it is designed to be sturdy, lightweight and easily constructed;
- it is easily converted from pack frame to chair and back again to pack frame;
- it can be used to hold a pack upright for the convenience of the user when it is used as a chair;
- it can be used with a padded hipbelt and ventilated back pads for the comfort of the user when it is used as a pack frame;
- it is designed so that cross members are curved to fit around the user's neck, shoulders, back and hips, to avoid the cross members rubbing against the user's neck, shoulders, back and hips;
- it is designed to have commercial appeal because it looks like a comfortable pack frame when folded into the pack frame position.

Although the description above contains many specificities, these should not be construed as limiting the scope of the invention but as merely providing illustrations of some of the presently preferred embodiments of this invention. For example, the shoulder straps could be attached at different positions, the clips that hold the leg members together when the invention is used as a pack frame could be designed differently, the front leg section could have cross members attached diagonally in an x shape rather than a u shaped front leg member with horizontal cross member, etc.

Thus the scope of the invention should be determined by the appended claims and their legal equivalents, rather than by the examples given.

I claim:

1. A combination pack frame and folding chair comprising:

(a) a folding chair with: a back section; a seat section pivotally connected to said back section, said seat section being generally rectangular in shape and having a rigid frame forming the sides and rear seat cross member of said seat section, and not having any rigid frame at the front of said seat section; a front leg section pivotally connected to said seat section wherein said front leg section has a left front leg, a right front leg and a front leg cross member connecting said left and right front legs and attached to said left and right front legs at positions below the points where said left and right legs are attached to said seat section; and a rear leg section pivotally connected to said seat section;

(b) shoulder straps attached to said folding chair, whereby said folding chair may be carried on a person's back; wherein said front leg cross member connecting said left and right legs of said front leg section is curved or recessed on one side to form a concave or recessed surface on the side that faces toward the user's back when said combination pack frame and folding chair is carried on a person's back, whereby said front leg cross member of said front leg section will not rub against the user's back when said combination pack frame and folding chair is carried on a person's back; a back pad attached to said front leg section; and a hip belt attached to said front leg section.

2. A combination pack frame and folding chair comprising: a folding chair with: a back section which is generally rectangular and wherein the top and sides of said back section are formed from tubular metal, and said back section comprises a fabric back panel with means to attach said fabric back panel to said sides of said back section; a seat section pivotally connected to said back section, said seat section being generally rectangular and having a rigid frame of tubular metal forming the sides and rear seat cross member of said seat section, and not having any rigid frame at the front of said seat section, and said seat section comprises a fabric seat panel with means to attach said fabric seat panel to said sides of said seat section; a u-shaped front leg section pivotally connected to said seat section, said front leg section comprising a left front leg, a right front leg, a front leg upper cross member connecting said left front leg and said right front leg and attached to said left and right front legs at positions below the points where said left and right front legs are attached to said seat section, and a front leg lower cross member connecting said left front leg and said right front leg and attached to said left and right front legs at positions below the points where said upper front leg cross member is attached to said left and right front legs; a rear leg section pivotally connected to said seat section wherein said rear leg section is u-shaped and comprises a rear leg cross member; a left armrest and a right armrest, each pivotally connected to said back section and to one end of said front leg section and to one end of said rear leg section;

(b) shoulder straps, attached at one end to said front leg upper cross member and at the other end to either side of said rear leg section, whereby said folding chair may be carried on a person's back; a padded hip belt attached to said front leg section; and a ventilated back pad attached to said front leg section; and wherein said top of said back section, said front leg lower cross member, said front leg upper cross member, said rear leg cross member, and said rear seat cross member of said seat section, are each curved or recessed on one side so that they each have a concave or recessed side closest to the body of a person carrying said combination pack frame and chair on the person's back, whereby when said combination pack frame and chair is carried on a person's back, only said shoulder straps, said back pad and said hip belt will come into contact with the person's body.

3. A combination pack frame and folding chair comprising:

(a) a folding chair with: a back section; a seat section pivotally connected to said back section, said seat section being generally rectangular in shape and having a rigid frame forming the sides and rear seat cross member of said seat section, and not having any rigid frame at the front of said seat section; a front leg section pivotally connected to said seat section wherein said front leg section has a left front leg, a right front leg and a front leg cross member connecting said left and right front legs and attached to said left and right front legs at positions below the points where said left and right legs are attached to said seat section; and a rear leg section pivotally connected to said seat section;

(b) shoulder straps attached to said folding chair, whereby said folding chair may be carried on a person's back; wherein said front leg cross member connecting said left and right legs of said front leg section is curved or recessed on one side to form a concave or recessed surface on the side that faces toward the user's back when said combination pack frame and folding chair is carried on a person's back, whereby said front leg cross member of said front leg section will not rub against the user's back when said combination pack frame and folding chair is carried on a person's back, and said rear leg section comprises a horizontal cross member that is curved or recessed on the side that faces the user's body when said combination pack frame and folding chair is in the pack frame position, whereby said horizontal cross member of said rear leg section will not rub against the user's back when said combination pack frame and folding chair is carried on a person's back.

4. A combination pack frame and folding chair comprising:

(a) a folding chair with: a back section; a seat section pivotally connected to said back section, said seat section being generally rectangular in shape and having a rigid frame forming the sides and rear seat cross member of said seat section, and not having any rigid frame at the front of said seat section; a front leg section pivotally connected to said seat section wherein said front leg section has a left front leg, a right front leg and a front leg cross member connecting said left and right front legs and attached to said left and right front legs at positions below the points where said left and right legs are attached to said seat section; and a rear leg section pivotally connected to said seat section;

(b) shoulder straps attached to said folding chair, whereby said folding chair may be carried on a person's back; wherein said front leg cross member connecting said left and right legs of said front leg section is curved or recessed on one side to form a concave or recessed surface on the side that faces toward the user's back when said combination pack frame and folding chair is carried on a person's back, whereby said front leg cross member of said front leg section will not rub against the user's back when said combination pack frame and folding chair is carried on a person's back, and said rear leg section is u-shaped and comprises a horizontal cross member which is curved or recessed on one side sufficiently, and extends to the rear of said combination pack frame and folding chair sufficiently, to allow said combination pack frame and folding chair, when it is in the chair position, to support the weight of a loaded backpack of up to approximately 60 pounds when said backpack is attached to the rear side of said back section of said combination pack frame and folding chair.

5. A combination pack frame and folding chair comprising:

(a) a folding chair with: a back section; a seat section pivotally connected to said back section, said seat section being generally rectangular in shape and having a rigid frame forming the sides and rear seat cross member of said seat section, and not having any rigid frame at the front of said seat section; a front leg section pivotally connected to said seat section wherein said front leg section has a left front leg, a right front leg and a front leg cross member connecting said left and right front legs and attached to said left and right front legs at positions below the points where said left and right legs are attached to said seat section; and a rear leg section pivotally connected to said seat section;

(b) shoulder straps attached to said folding chair, whereby said folding chair may be carried on a person's back; wherein said front leg cross member connecting said left and right legs of said front leg section is curved or recessed on one side to form a concave or recessed surface on the side that faces toward the user's back when said combination pack frame and folding chair is carried on a person's back, whereby said front leg cross member of said front leg section will not rub against the user's back when said combination pack frame and folding chair is carried on a person's back, and wherein said rear seat cross member of said seat section is curved or recessed on one side to form a concave or recessed surface on the side that faces the user's body when said combination pack frame and folding chair is in the pack frame position, whereby said rear seat cross member of said seat section will not come into contact with a person's body when said combination pack frame and folding chair is being carried on a person's back.

* * * * *